United States Patent [19]

Daniel

[11] 4,084,417

[45] Apr. 18, 1978

[54] SIMULATED DEADLOCK FOR DOORS

[76] Inventor: William H. Daniel, 541 Putman Rd., Rogers, Ark. 72756

[21] Appl. No.: 684,162

[22] Filed: May 7, 1976

[51] Int. Cl.[2] ..... E05B 17/00

[52] U.S. Cl. ..... 70/431; 70/447; 70/451

[58] Field of Search ..... 70/423, 424, 425, 426, 70/427, 428, 455, 451, DIG. 81, 431, 447; 312/204

[56] References Cited

U.S. PATENT DOCUMENTS

| | | | |
|---|---|---|---|
| 1,042,508 | 10/1912 | Waing | 70/110 |
| 1,305,959 | 6/1919 | Billings | 70/322 |
| 2,617,290 | 11/1952 | Schwartz | 70/455 X |
| 3,613,410 | 10/1971 | Shaw | 70/202 |
| 3,736,781 | 6/1973 | Foote | 70/456 R |

FOREIGN PATENT DOCUMENTS

| | | | |
|---|---|---|---|
| 539,443 | 11/1931 | Germany | 70/DIG. 81 |

*Primary Examiner*—Robert L. Wolfe
*Attorney, Agent, or Firm*—Young & Thompson

[57] ABSTRACT

A simulated deadlock for doors simulates and has the physical form of only that portion of a genuine deadlock which extends beyond the outer or exposed plane of the door. The simulation comprises a hollow plastic shell which outwardly reproduces the contours and color of a genuine deadlock but which terminates rearwardly in a flat plate having an adhesive thereon by which the simulation is secured to the door without piercing the door. Unauthorized entry is thus discouraged at a much lower cost than if a genuine deadlock were installed.

1 Claim, 3 Drawing Figures

SIMULATED DEADLOCK FOR DOORS

The present invention relates to a device for discouraging unauthorized entry through a door, by the simulation of a deadlock.

As is well known, it is a common practice to install deadlocks on doors, in order to discourage unauthorized entry. Such locks are of course preferred to ordinary spring latches, because they cannot be opened by the insertion of an implement between the bolt and the door jam.

Deadlocks can accordingly be forced by unauthorized persons, only by picking, which can be time consuming and in any event subjects the unauthorized person to the risk of detection during the time required for picking the deadlock. Accordingly, persons seeking unauthorized entry to premises will often pass up those premises whose doors are equipped with deadlocks, in favor of those premises whose doors are not.

Accordingly, the present invention is based on the recognition that a large part of the value of a deadlock is the fact that its mere presence tends to discourage attempts at unauthorized entry.

The present invention simulates the presence of a deadlock, but with a construction which is much simpler and less expensive to manufacture and install than is a genuine deadlock.

Accordingly, it is an object of the present invention to provide a simulated deadlock, which from the outside of the door substantially exactly duplicates the appearance of a genuine deadlock.

Another object of the present invention is the provision of a simulated deadlock which does not require that the door be pierced for its installation.

Finally, it is an object of the present invention to provide a simulated deadlock for doors, which will be simple and inexpensive to manufacture, easy to install, and durable in use.

Briefly, the objects of this invention are achieved, by providing a simulation of a deadlock in molded plastic in the form of a hollow shell closed on the rear side by a flat plate which is then secured to the shell. The flat plate on its rear side is provided with a pressure-sensitive adhesive covered by a quick-release film such as paper or the like. The cylinder of the deadlock is simulated by a rearwardly extending protrusion into the interior of the hollow shell, so that the key slot and its associated ribs have the appearance of substantial depth as in the case of a genuine deadlock. These and other objects, features and advantages of the present invention will become apparent from a consideration of the following description, taken in connection with the accompanying drawing, in which:

Figure 1:
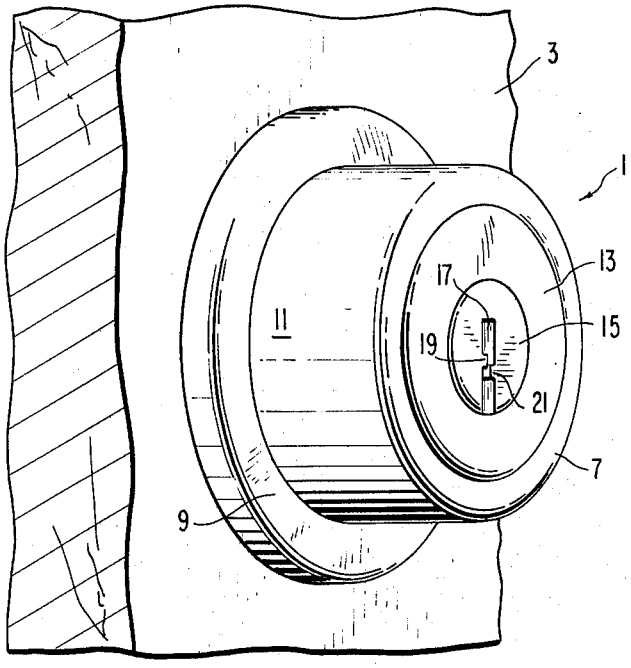
FIG. 1 is a perspective view of an installed simulated deadlock according to the present invention.
Figure 2:
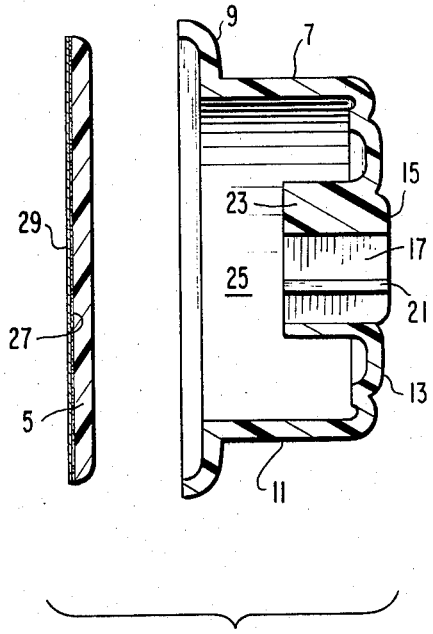
FIG. 2 is an exploded cross-sectional view, in a vertical plane, of the deadlock of the invention.
Figure 3:
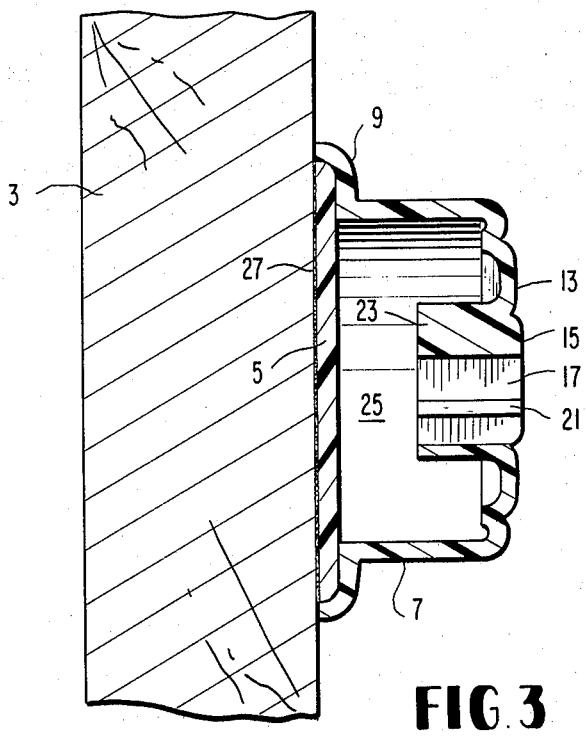
FIG. 3 is a view similar to FIG. 2 but showing the simulated deadlock of the invention assembled to a door.

Referring now to the drawing in greater detail, there is shown a simulated deadlock 1 according to the present invention, installed on a door 3 whose unauthorized entry is to be discouraged. The simulation comprises a flat circular base plate 5 that is secured to and closes the rear of a simulated hollow lock shell 7. Shell 7 has an annular peripheral flange 9 which is recessed to a depth to receive base plate 5 substantially flush with the rear circular edge of flange 9, plate 5 and flange 9 being cemented or heat welded together in the assembled position of the parts.

Shell 7 also comprises a forwardly extending cylindrical sleeve 11 that terminates forwardly in a face plate 13 which in turn carries centrally thereof a simulation of a cylinder 15. The simulation comprising cylinder 15 has a key slot 17 therein, into which protrude a pair of vertically spaced horizontal ribs 19 and 21 that extend parallel to the axis of shell 7.

It is possible that someone seeking unauthorized entry will look closely at key slot 17; and so it is desirable that this slot and its associated ribs 19 and 21 appear to have substantial depth. To this end, shell 7 is formed with a rearward central protrusion 23 that extends rearwardly into the cavity 25 of shell 7, thereby to provide an appropriate depth for slot 17 and ribs 19 and 21, which accordingly extend full depth of protrusion 23.

For easy installation of the simulated deadlock on a door without piercing the door, the simulation is provided with a layer of conventional pressure-sensitive adhesive 27 on the rear surface of base plate 5. A quick-release film 29, which may be paper or plastic and which is conventional for the purpose of protecting layers of pressure-sensitive adhesive prior to use, is provided over the layer of adhesive 27 and is peeled off when the simulation is to be applied to a door.

Therefore, in use, it is necessary only to peel off film 29 and, with the slot 17 oriented as in a genuine deadlock, that is, with slot 17 vertical and on the lower side of simulated cylinder 15, press the adhesive 27 against the door at the location desired, which of course will be close to but spaced from the vertical outer edge of the door and on the outer or exposed side of the door. As the simulation is a hollow plastic shell, it is quite light in weight and so the adhesive 27 has ample strength, over the extended circular area of base plate 5, to hold the simulation to the door in a permanent manner or until sufficient force is applied to remove the simulation from the door. Thus, ordinary use of the door will not knock off the simulation, nor will brushing against the simulation or other ordinary contact therewith. Indeed, as the slot 17 extends full depth of protrustion 23, an unauthorized person may even insert a key in slot 17 in the hope of being able to open the door, without detecting that the deadlock is a simulation. In this case, the inserted end of the key will simply contact the base plate 5 and the key of course cannot be turned.

The shell 7 can be injection molded from any suitable plastic such as polystyrene, monomethylmethacrylate, or other suitable thermosetting or thermoplastic resin. Shell 7 can thus be injection molded in one piece with exact detail. As to the detail, it is particularly to be noted that between the forward end of sleeve 11 and the face plate 13, as also between the face plate 13 and the cylinder 15, deep grooves are molded which simulate the junctions between corresponding separate parts of a genuine deadlock.

The surface finish of a genuine deadlock can also be substantially exactly simulated in the present invention, either by appropriate coloring of the plastic, or more preferably by conventional application of metal plating, e.g. brass, to the outer surface of the plastic by any known technique for this purpose.

From a consideration of the foregoing disclosure, therefore, it will be evident that all of the initially recited objects of the present invention have been achieved.

Although the present invention has been described and illustrated in connection with a preferred embodiment, it is to be understood that modifications and variations may be resorted to without departing from the spirit of the invention, as those skilled in this art will readilly understand. Such modifications and variations are considered to be within the purview and scope of the present invention as defined by the appended claims.

What is claimed is:

1. A simulated deadlock for doors, comprising a member which has a flat rear surface and forward surfaces which simulate only those portions of a deadlock which protrudes from the forward surface of a door to which the deadlock is applied, whereby said member may be adhesively applied to a door to discourage attempts at unauthorized entry through the door, said member being in the form of a hollow plastic shell, said shell having a peripheral flange which is hollow and opens rearwardly and in which a flat base plate is secured, the rear surface of said base plate comprising said flat rear surface of the simulated deadlock, said shell having in its forward central region a rearwardly extending protrusion which is pierced by a simulated key slot, horizontal ribs on said protrusion, said ribs extending into said key slot, a pressure-sensitive adhesive on said flat rear surface, and a quick-release film covering said adhesive prior to use, the outer surface of said shell being brass plated.

* * * * *